US007637787B2

(12) United States Patent
Chien et al.

(10) Patent No.: US 7,637,787 B2
(45) Date of Patent: Dec. 29, 2009

(54) AUDIO JACK CONNECTOR

(75) Inventors: Min-Lung Chien, Taipei Hsien (TW); Kai-Ray Cheng, Taipei Hsien (TW); Hong-Wei Zheng, Taipei Hsien (TW); Ya-Ping Liang, Taipei Hsien (TW)

(73) Assignee: Advanced Connectek Inc., Taipei Hsien (TW)

( * ) Notice: Subject to any disclaimer, the term of this patent is extended or adjusted under 35 U.S.C. 154(b) by 0 days.

(21) Appl. No.: 12/313,894

(22) Filed: Nov. 25, 2008

(65) Prior Publication Data

US 2009/0176414 A1 Jul. 9, 2009

(30) Foreign Application Priority Data

Jan. 4, 2008 (TW) ..... 97200255 U

(51) Int. Cl.
*H01R 24/04* (2006.01)

(52) U.S. Cl. ..... 439/668

(58) Field of Classification Search ..... 439/668, 439/669

See application file for complete search history.

(56) References Cited

U.S. PATENT DOCUMENTS 7,387,543 B1 * 6/2008 Wu et al. ..... 439/668
7,445,515 B1 * 11/2008 Yuan et al. ..... 439/668
7,534,146 B2 * 5/2009 Chien et al. ..... 439/668
2007/0249235 A1 * 10/2007 Wu ..... 439/668
2009/0176414 A1 * 7/2009 Chien et al. ..... 439/668

* cited by examiner

*Primary Examiner*—James Harvey
(74) *Attorney, Agent, or Firm*—William E. Pelton, Esq.; Cooper & Dunham LLP

(57) ABSTRACT

An audio jack connector has an insulative housing and a plurality of conductive terminals mounted in the housing. The housing includes a body, a mating head and an insertion hole, wherein the body has a rear wall, two opposite sidewalls, a top wall and a bottom wall. A plurality of terminal slots and notches is only defined through the bottom wall, keeping other walls of the housing from forming any opening against the entry of the moisture and dust. The mating head is mounted on the body opposite to the rear wall. The insertion hole is defined through the mating head, extends into the body and communicates each terminal slot. Each notch is parallel to one another and communicates a corresponding terminal slot. Each conductive terminal has a base portion, a mounting portion, a connection portion, a contacting portion and a resilient portion.

6 Claims, 5 Drawing Sheets

AUDIO JACK CONNECTOR

BACKGROUND OF THE INVENTION

1. Field of the Invention

The present invention relates to an audio jack connector, and more particularly to a moisture-proof and dust-proof audio jack connector.

2. Description of Related Art

Audio jacks and corresponding jack connectors are commonly applied to audio devices for transmission of audio signals. The conventional jack connector comprises an insulative housing and a plurality of conductive terminals mounted in the housing. To assemble the conductive terminals in the housing much easier, the insulative housing is defined with many slots through different sides of the housing. Since the slots are formed through the different sides of the housing, such as the top side and two opposite lateral sides, the moisture and dust may enter the inside of the housing.

To overcome the shortcomings, the present invention provides an audio jack connector to mitigate or obviate the aforementioned problems.

SUMMARY OF THE INVENTION

The main objective of the invention is to provide an audio jack connector that has a substantial closed space against the entry of dust and moisture.

To accomplish the objective, the audio jack connector has an insulative housing and a plurality of conductive terminals mounted in the housing. The housing includes a body, a mating head and an insertion hole, wherein the body has a rear wall, two opposite sidewalls, a top wall and a bottom wall. A plurality of terminal slots and notches is only defined through the bottom wall, keeping other walls of the housing from forming any opening to prevent the moisture and dust from entering the inside of the housing. The mating head is mounted on the body opposite to the rear wall. The insertion hole is defined through the mating head, extends into the body and communicates each terminal slot. Each notch is parallel to one another and communicates a corresponding terminal slot. Each conductive terminal has a base portion, a mounting portion, a connection portion, a contacting portion and a resilient portion.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
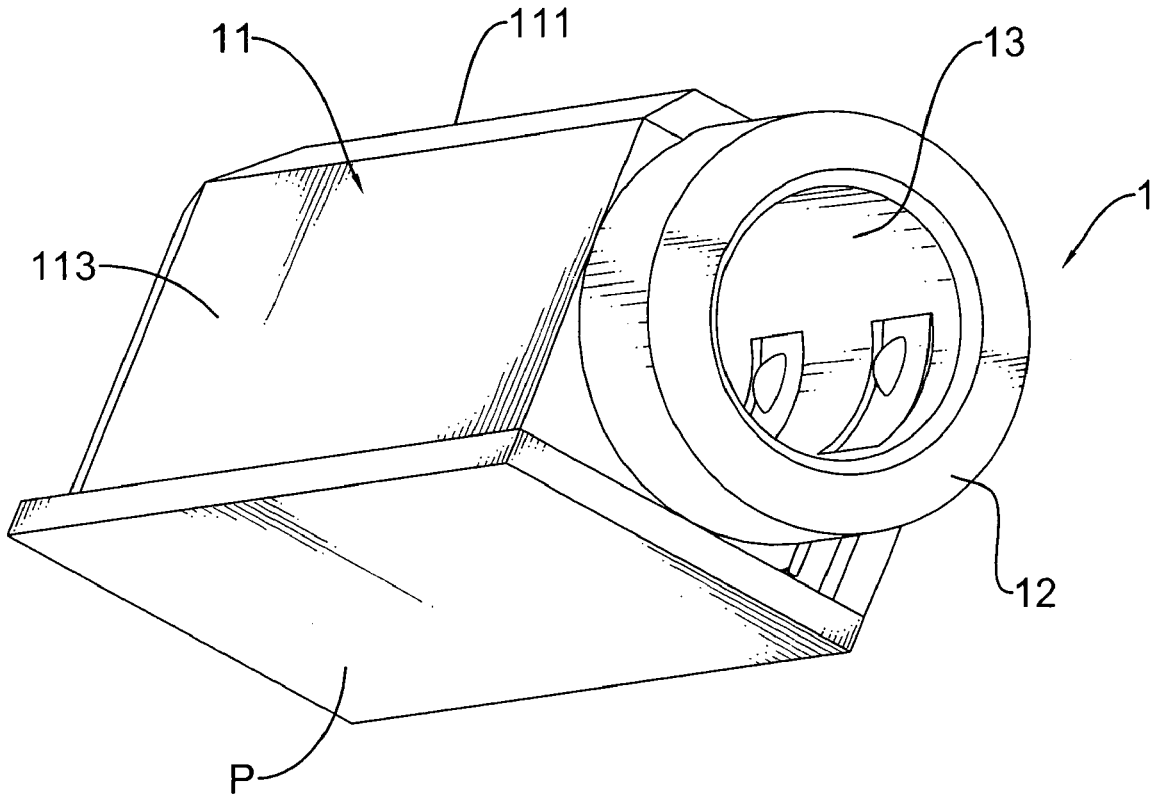
FIG. 1 is a perspective view of an audio jack connector in accordance with the present invention mounted on a circuit board.
Figure 2:
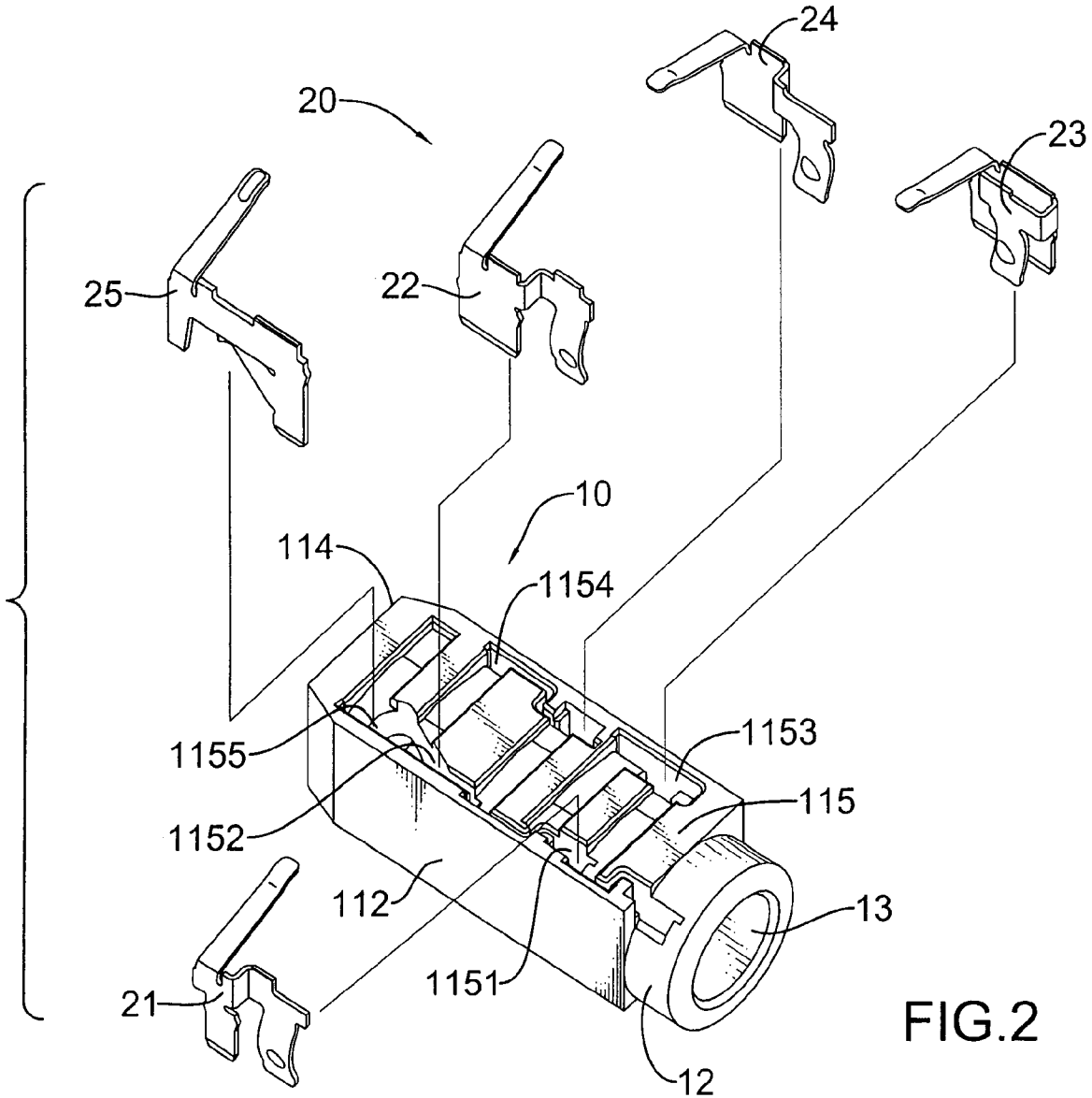
FIG. 2 is an exploded perspective view of the audio jack connector of FIG. 1.

With reference to FIGS. 1, 2, an audio jack connector (1) in accordance with the present invention can be electrically mounted on a circuit board (P) and comprises an insulative housing (10) and a plurality of conductive terminals (20).

Figure 3:
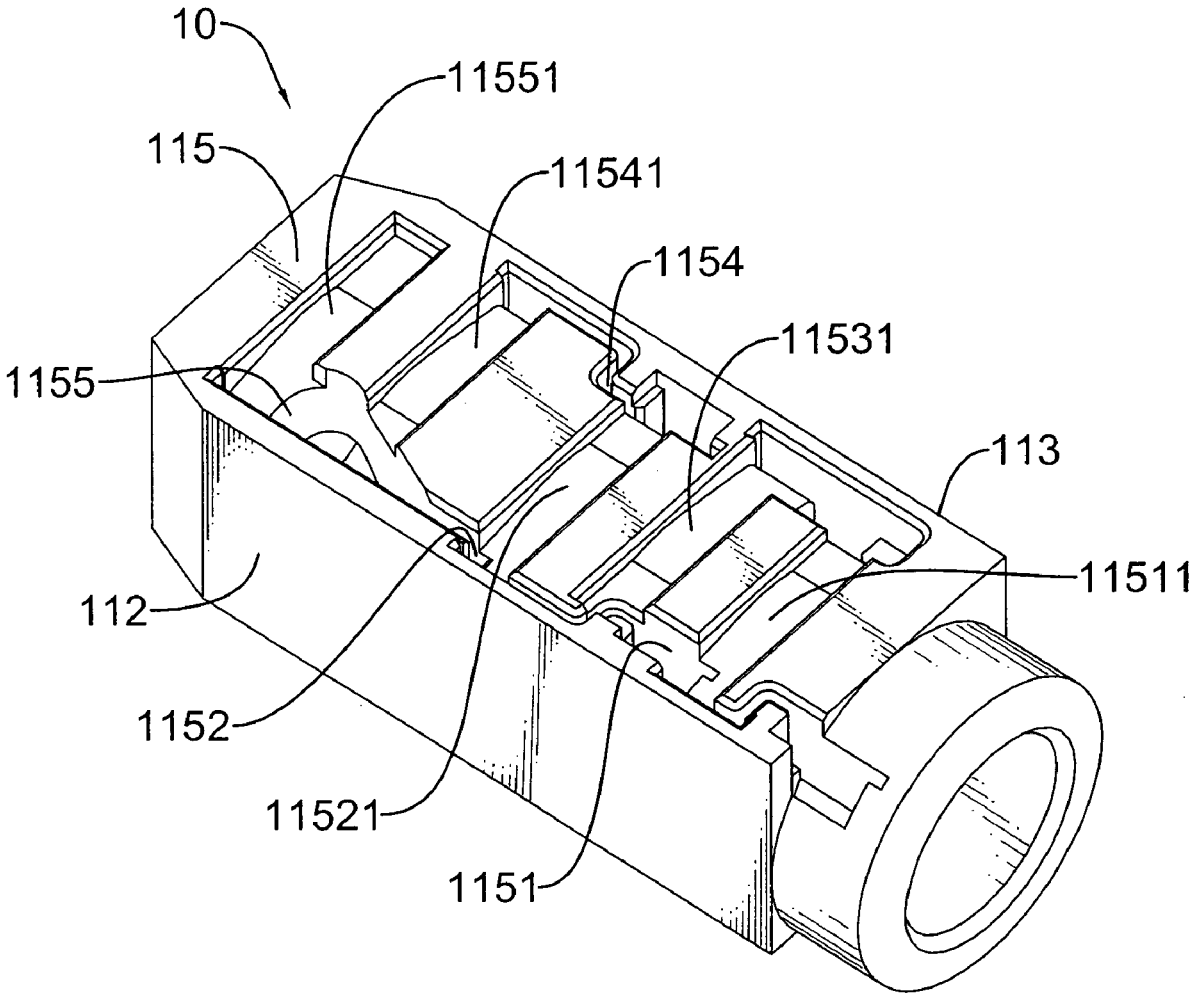
FIG. 3 is a bottom perspective view of an insulative housing of the audio jack connector of FIG. 1.
Figure 4A:
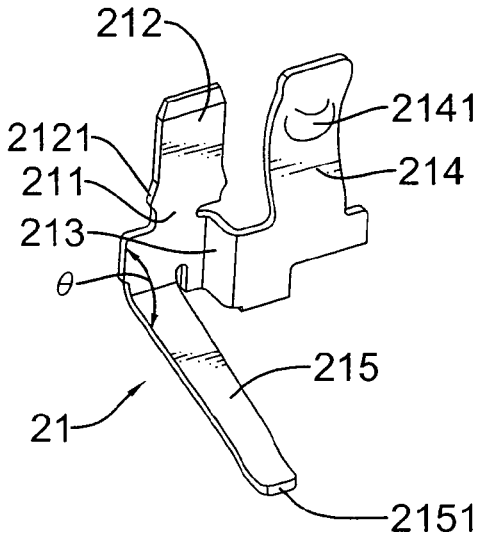
FIGS. 4A-4E are perspective views of different conductive terminals of the audio jack connector of FIG. 1.
Figure 4B:
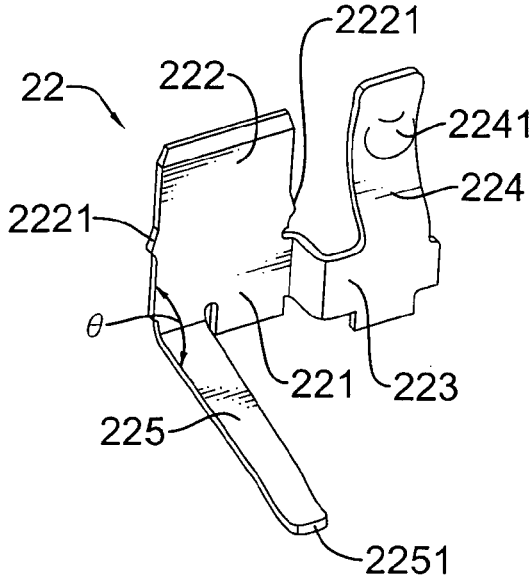
Figure 4C:
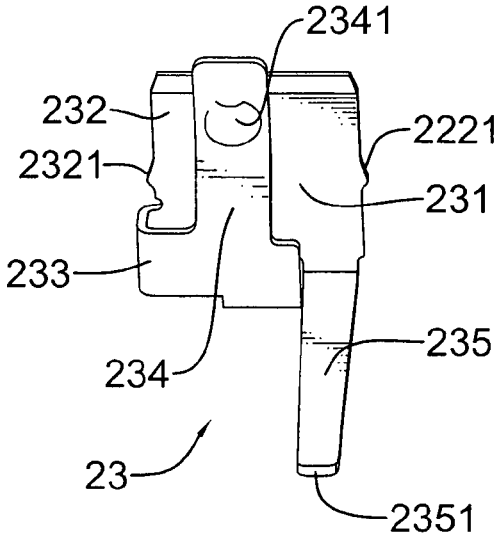
Figure 4D:
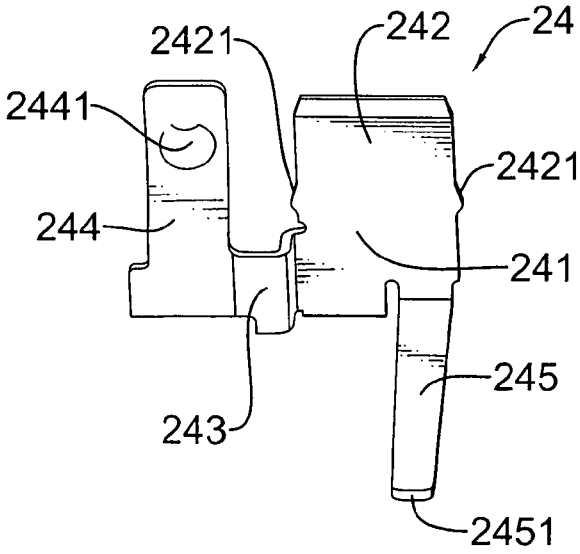
Figure 4E:
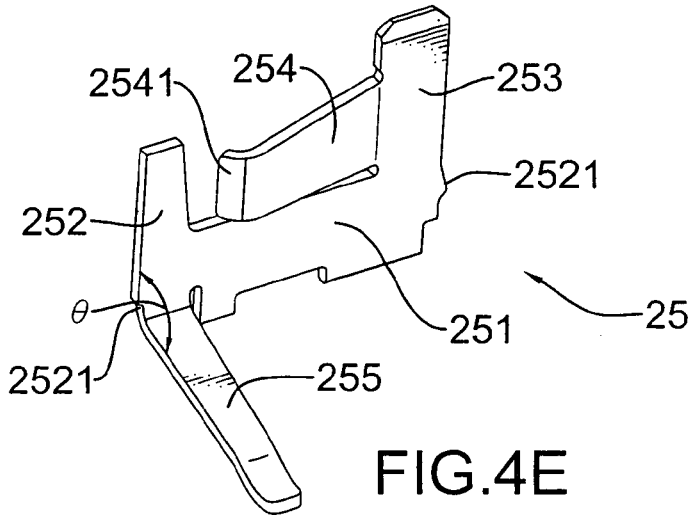
Figure 5:
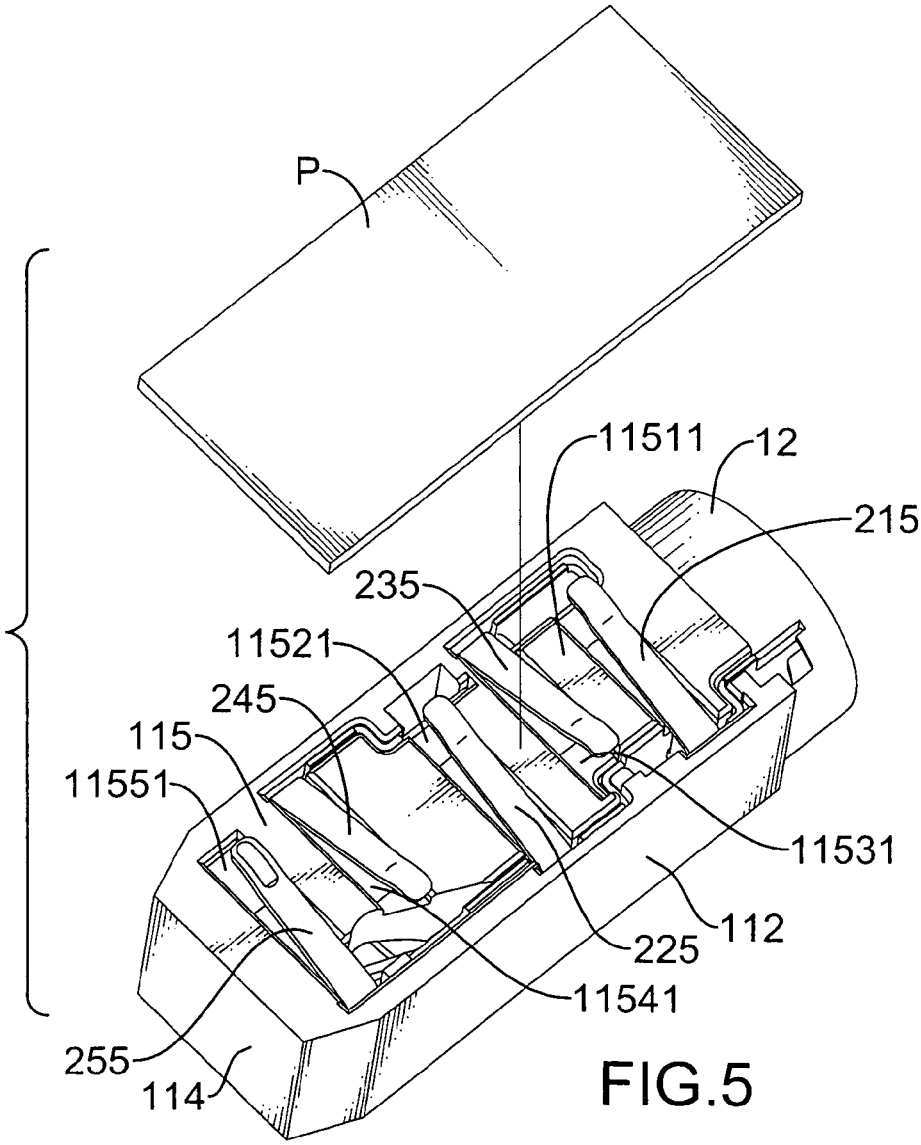
FIG. 5 is an exploded perspective view of the audio jack connector of FIG. 1 and the circuit board.

With further reference to FIGS. 3 and 5, the insulative housing (10) comprises a body (11), a mating head (12) and an insertion hole (13).

The body (11) has a top wall (111), a first sidewall (112), a second sidewall (113), a rear wall (114) and a bottom wall (115). The top wall (111), the first sidewall (112) and the second sidewall (113) are respectively joined to three edges of the rear wall (114) while the top wall (111) is further connected between the first sidewall (112) and the second sidewall (113). There is no pore, slot, hole, opening or the like defined through the top wall (111), first sidewall (112), second sidewall (113) and the rear wall (114). Different to other walls, the bottom wall (115) to be mounted on the circuit board (P) has defined with a plurality of terminals slots (1151, 1152, 1153, 1154 and 1155) and a plurality of notches (11511, 11521, 11531, 11541,and 11551).

The mating head (12) is mounted on the body (11) opposite to the rear wall (114).

The insertion hole (13) is defined through the mating head (12) and further extends into the body (11), but not through the rear wall (114).

The plurality of notches (11511, 11521, 11531, 11541 and 11551) are parallel to one another between the first sidewall (112) and the second sidewall (113) and perpendicular to the first sidewall (112). Each of the notches (11511, 11521, 11531, 11541 and 11551) communicates a corresponding terminal slot (1151, 1152, 1153, 1154 and 1155). In this embodiments, five terminal slots (1151, 1152, 1153, 1154 and 1155) and five notches (11511, 11521, 11531, 11541 and 11551) are provided on the bottom wall(115).

The first and second terminal slots (1151 and 1152) are adjacent to the first sidewall (112). The third and fourth terminal slots (1153 and 1154) are adjacent to the second sidewall (113). The fifth terminal slot (155) is adjacent to the rear wall (114). All the terminal slots(1151, 1152, 1153, 1154 and 1155) communicate the insertion hole (13).

With further reference to FIGS. 4A to 4E, the plurality of conductive terminals (20) are assembled in the terminal slots (1151, 1152, 1153, 1154 and 1155) of the housing (10) from the bottom wall (115). In this embodiment, five conductive terminals (21, 22, 23, 24 and 25) are respectively mounted in the terminal slots (1151, 1152, 1153, 1154 and 1155). Each of the conductive terminal (21, 22, 23, 24 and 25) has a base portion (211, 221, 231, 241 and 251), a mounting portion (212, 222, 232, 242 and 252), a connecting portion (213, 223, 233, 243 and 253), a contact portion (214, 224, 234, 244 and 254) and a resilient portion (215, 225, 235, 245 and 255).

With regard to the first conductive terminal (21), the base portion (211) has two opposite edges and one end. The mounting potion (212) extends from one edge of the base portion (211). The connecting portion (213) protrudes from the end of the base portion (211) but is bent slightly to be not coplanar with the base portion (211). The contacting portion (214) extends from the connecting portion (213) in a direction the same as that of the mounting portion (212) and is curved in cross section. The contact portion (214) may have a protruding point (2141) near a distal end of the contact portion (214). The resilient portion (215) protrudes from the other edge of the base portion (211) with an angle (θ) larger than 90 degrees in a direction perpendicular to the mounting portion (212) and the contacting portion (214). The resilient portion (215) has a distal end as a touch pad (2151) to electrically contact the circuit board (P).

When the first conductive terminal (21) is mounted in the first terminal slot (1151), the contacting portion (214) and its protruding point (2141) protrude into the insertion hole (13) and the resilient portion (215) is sustained above the first notch (11511). When a force is applied to the resilient portion (215), the resilient portion (215) is pressed in the first notch (11511) and coplanar with the bottom wall (115). The mounting portion (212) may have a lock projection (2121) formed on an edge of the mounting portion and firmly engaged in the first terminal slot (1151).

With regard to the second conductive terminal (22), the structure of the second conductive terminal (22) is similar to the first terminal (21). The base portion (221) has two opposite edges and one end. The mounting potion (222) extends from one edge of the base portion (221). The connecting portion (223) protrudes from the end of the base portion (221) and is bent slightly to be not coplanar with the base portion (221). The contacting portion (224) extends from the connecting portion (223) in a direction the same as that of the mounting portion (222) and is curved in cross section. The contact portion (224) may have a protruding point (2241) near a distal end of the contact portion (224). The resilient portion (225) protrudes from the other edge of the base portion (221) with an angle (θ) larger than 90 degrees in a direction perpendicular to the mounting portion (222) and the contacting portion (224). The resilient portion (225) has a distal end as a touch pad (2251) to electrically contact the circuit board (P).

When the second conductive terminal (22) is mounted in the second terminal slot (1152), the contacting portion (224) and its protruding point (2241) protrude into the insertion hole (13) and the resilient portion (225) is sustained above the second notch (11521). When a force is applied to the resilient portion (225), the resilient portion (225) is pressed in the second notch (11521) and coplanar with the bottom wall (115). The mounting portion (222) may have a lock projection (2221) formed on an edge of the mounting portion (222) to firmly engage in the second terminal slot (1152).

The third conductive terminal (23) is assembled in the third terminal slot (1153). The base portion (231) has two opposite edges and one end. The mounting potion (232) extends from one edge of the base portion (231). The connecting portion (233) protrudes from the end of the base portion (231) and is further bent to be U-shaped to be parallel in base portion (231). The contacting portion (234) extends from the connecting portion (233) in a direction the same as that of the mounting portion (232) and is curved in cross section. The contact portion (234) may have a protruding point (2341) near a distal end of the contact portion (234). The resilient portion (235) protrudes from the other edge of the base portion (231) with an angle larger than 90 degrees in a direction perpendicular to the mounting portion (232) and the contacting portion (234). The resilient portion (235) has a distal end as a touch pad (2351) to electrically contact the circuit board (P).

When the third conductive terminal (23) is mounted in the third terminal slot (1153), the contacting portion (234) and its protruding point (2341) protrude into the insertion hole (13) and the resilient portion (235) is sustained above the third notch (11531). When a force is applied to the resilient portion (235), the resilient portion (235) is pressed in the third notch (11531) and coplanar with the bottom wall (115). The mounting portion (232) may have a lock projection (2321) formed on an edge of the mounting portion (232) to firmly engage in the third terminal slot (1153).

With regard to the fourth conductive terminal (24), the base portion (241) has two opposite edges and one end. The mounting potion (242) extends from one edge of the base portion (241). The connecting portion (243) protrudes from the end of the base portion (241) but is bent slightly to be not coplanar with the base portion (241). The contacting portion (244) extends from the connecting portion (243) in a direction the same as that of the mounting portion (242) and is curved in cross section. The contact portion (244) may have a protruding point (2441) near a distal end of the contact portion (244). The resilient portion (245) protrudes from the other edge of the base portion (241) with an included angle larger than 90 degrees in a direction perpendicular to the mounting portion (242) and the contacting portion (244). The resilient portion (245) has a distal end as a touch pad (2451) to electrically contact the circuit board (P).

When the fourth conductive terminal (24) is mounted in the fourth terminal slot (1154), the contacting portion (244) and its protruding point (2441) protrude into the insertion hole (13) and the resilient portion (245) is sustained above the fourth notch (11541). When a force is applied to the resilient portion (245), the resilient portion (245) is pressed in the fourth notch (11541) and coplanar with the bottom wall (115). The mounting portion (242) may have a lock projection (2421) formed on an edge of the mounting portion (242) to firmly engage in the fourth terminal slot (1154).

With regard to the fifth conductive terminal (25), the base portion (251) has two opposite edges and two ends. The mounting potion (252) and the connection portion (253) extend in the same direction from the same edge of the base portion (251) adjacent to the two ends respectively. The contacting portion (254) extends from the connecting portion (253) toward the mounting portion (252) and perpendicular to the connecting portion (253). The contact portion (254) may have a protruding point (2541) near a distal end of the contact portion (254). The resilient portion (255) protrudes from the other edge of the base portion (251) with an included angle (θ) larger than 90 degrees in a direction perpendicular to the mounting portion (252). The resilient portion (255) has a distal end as a touch pad (2551) to electrically contact the circuit board (P).

When the fifth conductive terminal (25) is mounted in the fifth terminal slot (1155), the contacting portion (254) and its protruding point (2541) protrude into the insertion hole (13) and the resilient portion (255) is sustained above the fifth notch (11551). When a force is applied to the resilient portion (255), the resilient portion (255) is pressed in the fifth notch (11551) and coplanar with the bottom wall (115). The mounting portion (252) may have a lock projection (2521) formed on an edge of the mounting portion (252) and firmly engaged in the fifth terminal slot (1155).

When the audio jack connector (1) is mounted on the circuit board (P), the resilient portions (215, 225, 235, 245 and 255) of all conductive terminals (20) are held in the terminal slots (1151, 1152, 1153, 1154 and 1155). Therefore, the bottom wall (115) of the housing (10) can be mounted on the circuit board (P) smoothly. Because there is no slots, holes or openings formed on the top wall (111), the first sidewall (112), the second side (113) and the rear wall (114), the audio jack connector (1) has a closed inner space when an audio jack is correspondingly inserted into the housing (11) to provide moisture-proof and dust-proof effects.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An audio jack connector comprising:

an insulative housing comprising a body having a top wall free from any pore;

a first sidewall free from any pore;

a second sidewall free from any pore;

a rear wall free from any pore;

a bottom wall;

a plurality of terminal slots defined through the bottom wall and;

a plurality of notches parallel to one another and defined through the bottom wall, each of the plurality of notches communicating a corresponding one of the plurality of terminal slots;

a mating head formed on the body opposite to the rear wall; and an insertion hole defined through the mating head, extending into the body and communicating each of the plurality of terminal slots;

a plurality of conductive terminals respectively assembled in the plurality of terminal slots, each conductive terminal having a base portion having two opposite edges and one end;

a mounting portion extending from one edge of the base portion in a first direction;

a connecting portion extending from the end of the base portion;

a contacting portion extending from the connecting portion and projecting into the insertion hole; and a resilient portion protruding from the other edge of the base portion in a second direction perpendicular to the first direction and sustained above a corresponding one of the plurality of notches.

2. The audio jack connector as claimed in claim 1, wherein each mounting portion has a lock projection.

3. The audio jack connector as claimed in claim 1, wherein each resilient portion is pressed in the corresponding one of the plurality of notches when a force is applied to the resilient portion.

4. The audio jack connector as claimed in claim 1, wherein each contacting portion has a protruding point.

5. The audio jack connector as claimed in claim 1, wherein each resilient portion has a distal end as a touch pad.

6. The audio jack connector as claimed in claim 1, wherein an angle larger than 90 degrees is formed between the base portion and the resilient portion of each conductive terminal.

* * * * *